US011160346B2

(12) United States Patent
Moore et al.

(10) Patent No.: US 11,160,346 B2
(45) Date of Patent: Nov. 2, 2021

(54) HAIR STYLING APPLIANCE

(71) Applicant: JEMELLA LIMITED, Leeds (GB)

(72) Inventors: Timothy David Moore, Hertfordshire (GB); Mark Andrew Gagiano, Western Australia (AU)

(73) Assignee: Jemella Limited, Leeds (GB)

( * ) Notice: Subject to any disclaimer, the term of this patent is extended or adjusted under 35 U.S.C. 154(b) by 257 days.

(21) Appl. No.: 15/584,998

(22) Filed: May 2, 2017

(65) Prior Publication Data

US 2017/0231350 A1 Aug. 17, 2017

Related U.S. Application Data

(63) Continuation-in-part of application No. 14/398,445, filed as application No. PCT/GB2013/051099 on Apr. 30, 2013, now abandoned.

(30) Foreign Application Priority Data

May 1, 2012 (GB) ..... 1207549

(51) Int. Cl.
*A45D 2/00* (2006.01)
*A45D 1/06* (2006.01)
(Continued)

(52) U.S. Cl.
CPC ..... *A45D 2/40* (2013.01); *A45D 2/001* (2013.01); *A45D 1/04* (2013.01); *A45D 1/28* (2013.01)

(58) Field of Classification Search
CPC ... A45D 1/00; A45D 1/04; A45D 1/06; A45D 1/08; A45D 1/10; A45D 1/12; A45D 1/14;
(Continued)

(56) References Cited

U.S. PATENT DOCUMENTS 1,365,079 A 1/1921 Bardsley
3,182,667 A 5/1965 Den Beste
(Continued)

FOREIGN PATENT DOCUMENTS

CN 101744444 A 6/2010
DE 3115569 A1 12/1982
(Continued)

OTHER PUBLICATIONS

International Search Report and Written Opinion dated Jul. 10, 2013 re: Application No. PCT/GB2013/051099; citing: US 2010/147323 A1 and WO 2009/2123424.
(Continued)

*Primary Examiner* — Yogesh P Patel
*Assistant Examiner* — Jennifer Gill
(74) *Attorney, Agent, or Firm* — Schwegman Lundberg & Woessner, P.A.

(57) ABSTRACT

A hair styling apparatus includes a first and a second arm each having a heatable plate and an arm member. The first and second arms are moveable between a closed position, in which the heatable plate of the first arm is adjacent the heatable plate of the second arm, and an open position, in which the heatable plates of each arm are spaced apart. The heatable plate of at least one of the arms is coupled to a respective arm member about a pivot arranged to allow the heatable plate to move relative to the respective arm member about an axis transverse to the length of said respective arm member such that the plate pivots.

12 Claims, 6 Drawing Sheets

(51) Int. Cl.
*A45D 2/40* (2006.01)
*A45D 1/28* (2006.01)
*A45D 1/04* (2006.01)

(58) Field of Classification Search
CPC . A45D 1/28; A45D 2/00; A45D 2/001; A45D 2/002; A45D 2/2428; A45D 2/38; A45D 2/40; A45D 2/48; A45D 6/20; A45D 7/02
USPC ..... 132/223–225
See application file for complete search history.

(56) References Cited

U.S. PATENT DOCUMENTS

| | | | | |
|---|---|---|---|---|
| 4,739,151 | A | 4/1988 | Smal | |
| 4,968,870 | A | 11/1990 | Moon | |
| 5,223,694 | A | 6/1993 | Tsuji et al. | |
| 5,522,407 | A | 6/1996 | Kelsey | |
| 8,080,764 | B2 | 12/2011 | Shami et al. | |
| 8,232,505 | B2 | 7/2012 | Hottenrott et al. | |
| 2004/0163661 | A1 | 8/2004 | Carlucci | |
| 2004/0237990 | A1* | 12/2004 | Choi | A45D 1/04 132/224 |
| 2005/0252519 | A1 | 11/2005 | Kayser | |
| 2007/0119844 | A1 | 5/2007 | Lo et al. | |
| 2007/0240731 | A1* | 10/2007 | Mukai | A45D 1/04 132/224 |
| 2008/0216860 | A1 | 9/2008 | Legrain | |
| 2010/0078038 | A1* | 4/2010 | Shami | A45D 1/08 132/224 |
| 2010/0083978 | A1* | 4/2010 | Hottenrott | A45D 1/06 132/211 |
| 2010/0147323 | A1 | 6/2010 | Hafemann | |
| 2010/0170883 | A1 | 7/2010 | Legrain et al. | |
| 2013/0319452 | A1* | 12/2013 | Joo | A45D 2/001 132/223 |
| 2015/0136169 | A1 | 5/2015 | Moore et al. | |

FOREIGN PATENT DOCUMENTS

| | | | |
|---|---|---|---|
| DE | 202009001872 | U1 | 8/2010 |
| EP | 2641501 | A1 | 9/2013 |
| GB | 2016051 | A | 9/1979 |
| GB | 2082908 | A | 3/1982 |
| GB | 2163574 | A | 2/1996 |
| GB | 2318544 | A | 4/1998 |
| GB | 2402876 | A | 12/2004 |
| GB | 2477834 | A | 8/2011 |
| KR | 10-2009-0106269 | A | 10/2009 |
| KR | 10-2009-0119155 | A | 11/2009 |
| KR | 2020110004204 | * | 11/2011 |
| WO | 2009123424 | A1 | 10/2009 |
| WO | WO-2013164594 | A1 | 11/2013 |

OTHER PUBLICATIONS

International Search Report and Written Opinion dated Jul. 16, 2013 re: Application No. PCT/GB2013/051023; citing: GB 2 477 834 A, GB 2 402 876 A, U.S. Pat. No. 4,968,870 A and US 20071119844 A1.
UK Examination Report dated Jul. 31, 2014 re: Application No. GB1207549.5, pp. 2.
UKIPO Search and Examination Report dated Aug. 24, 2012 re: Application No. GB1207549.5; pp. 7; citing: US 2010/0147323 A1, DE 202009001872 U1.
UKIPO Search Report dated Aug. 22, 2012 re: Application No. GB1207548.7; pp. 4; citing: GB 2082908 A and U.S. Pat. No. 4,968,870 A.
UKIPO Examination Report dated Mar. 21, 2014 re: Application No. GB1207548.7; p. 1; citing: GB2477834 A and GB 2402876 A.
"U.S. Appl. No. 14/398,445, Examiner Interview Summary dated Mar. 20, 2017", 4 pgs.
"U.S. Appl. No. 14/398,445, Final Office Action dated Dec. 2, 2016", 23 pgs.
"U.S. Appl. No. 14/398,445, Non-Final Office Action dated Feb. 29, 2016", 25 pgs.
"U.S. Appl. No. 14/398,445, Preliminary Amendment filed Oct. 31, 2014", 7 pgs.
"U.S. Appl. No. 14/398,445, Response filed Jan. 15, 2016 to Restriction Requirement dated Nov. 19, 2015", 7 pgs.
"U.S. Appl. No. 14/398,445, Response filed Aug. 29, 2016 to Non-Final Office Action dated Feb. 29, 2016", 14 pgs.
"U.S. Appl. No. 14/398,445, Restriction Requirement dated Nov. 19, 2015", 7 pgs.
"Australian Application Serial No. 2013255614, First Examiner Report dated Jan. 20, 2016", 3 pgs.
"Australian Application Serial No. 2013255614, Response filed Aug. 3, 2016 to First Examiner Report dated Jan. 20, 2016", 25 pgs.
"Chinese Application Serial No. 201380023033.1, Office Action dated Apr. 20, 2017", (w/ English Translation), 15 pgs.
"Chinese Application Serial No. 201380023033.1, Office Action dated Aug. 10, 2016", (w/ English Translation), 15 pgs.
"Chinese Application Serial No. 201380023033.1, Written Argument and Amendment filed Jun. 12, 2017 in response to Office Action dated Apr. 20, 2017", (w/ English Translation of Argument), 14 pgs.
"Chinese Application Serial No. 201380023033.1, Written Argument and Amendment filed Dec. 21, 2016 in response to Office Action dated Aug. 10, 2016", (w/ English Translation of Argument), 10 pgs.
"European Application Serial No. 13719178.9, Office Action dated Oct. 2, 2017", 4 pgs.
"European Application Serial No. 13719178.9, Response filed Jan. 24, 2018 to Office Action dated Oct. 2, 2017", 14 pgs.
"European Application Serial No. 13719178.9, Response filed Apr. 27, 2015 to Communication pursuant to Rules 161(1) and 162 EPC dated Dec. 18, 2014", 14 pgs.
"International Application Serial No. PCT/GB2013/051099, International Preliminary Report on Patentability dated Nov. 13, 2014", 9 pgs.
"United Kingdom Application Serial No. 1207549.5, Response filed Jun. 27, 2014 to Office Action dated Aug. 24, 2012", 28 pgs.
"United Kingdom Application Serial No. 1207549.5, Response filed Sep. 1, 2014 to Office Action dated Jul. 31, 2014", 31 pgs.
"United Kingdom Application Serial No. 1720073.4, Combined Search and Examination Report dated Jan. 30, 2018", 7 pgs.

* cited by examiner

HAIR STYLING APPLIANCE

CROSS-REFERENCE TO RELATED APPLICATIONS

This application is a continuation-in-part of and claims the benefit of U.S. patent application Ser. No. 14/398,445, filed on Oct. 31, 2014, which in turn claims priority to International Application No. PCT/GB2013/051099, filed on Apr. 30, 2013, which in turn claims priority to British Application No. 1207549.5, filed on May 1, 2012. The entire contents of the aforementioned applications are herein expressly incorporated by reference.

FIELD OF THE INVENTION

The invention relates to hair styling apparatus, in particular those for straightening hair.

BACKGROUND TO THE INVENTION

There are a variety of apparatus available for styling hair. One form of apparatus is known as a straightener which employs plates that are heatable. To style, hair is clamped between the plates and heated above a transition temperature where it becomes mouldable. Depending on the type, thickness, condition and quantity of hair, the transition temperature may be in the range of 160-200° C.

A hair styling appliance can be employed to straighten, curl and/or crimp hair.

A hair styling appliance for straightening hair is commonly referred to as a "straightening iron" or "hair straightener". FIG. 1 depicts an example of a typical hair straightener 1. The hair straightener 1 includes first and second arms 2*a*, 2*b* each comprising heatable plates 3*a*, 3*b* coupled to heaters (not shown) in thermal contact with the heatable plates. The heatable plates are substantially flat and are arranged on the inside surfaces of the arms in an opposing formation. During the straightening process, hair is clamped between the hot heatable plates and then pulled under tension through the plates so as to mould it into a straightened form. The hair straightener may also be used to curl hair by rotating the hair straightener 180° towards the head prior to pulling the hair through the hot heatable plates.

Ceramic heaters, in particular those with a pure resistive profile enable optimisation of the thermal control loop, thus allowing the plates in contact with hair to remain near transition temperature during styling and thermal load application. This leads to longevity of style.

A hair styling appliance for crimping hair is commonly referred to as a "crimping iron". FIG. 2 depicts an example of a typical crimping iron 10. The crimping iron includes first and second arms 12*a* and 12*b*. Each arm comprises a heatable plate 13*a*, 13*b* coupled to heaters (not shown) in thermal contact with the heatable plates. The heating plates have a saw tooth (corrugated, ribbed) surface and are arranged on the inside surfaces of the arms in an opposing formation. During the crimping process, the hair is clamped between the hot heatable plates until it is moulded into a crimped shape.

In the process of clamping hair between the plates, hair may be pushed off the end of the heating plates as the arms are clamped over the hair, meaning the arms need to be released and the section of hair reclamped. This can lead to the styling process taking longer. To overcome this problem, one approach has been to arrange the arms and plates such that they are angled towards one another to a point at the ends of the plates, meaning that as a section of hair is clamped the endpoints provide a barrier to escaping hair.

In order to maintain effective styling, it is desirable that the plates also retain an even clamping force across the section of hair between the plates during the styling process.

In some conventional devices, the arms of the styling appliance may flex when squeezed by a user. This helps to realign the plates with a section of hair now clamped. However it may be hard for a user to apply such a squeezing pressure for anything but a short period of time. Furthermore, by requiring such a flex in the arms, the choice of materials, and construction of the styling appliance is limited. The applicant has recognised a need to improve existing hair styling appliances to address these problems.

SUMMARY OF THE INVENTION

According to a first aspect of the invention there is provided a hair styling apparatus comprising a first and a second arm, coupled at one end, and each comprising a heatable plate and arm member, wherein the first and second arms are moveable between a closed position in which the heatable plate of the first arm is adjacent the heatable plate of the second arm and an open position in which the heatable plates of each arm are spaced apart, and wherein the heatable plate of at least one of the arms is coupled to a respective arm member by means of a plate pivot arranged to allow the heatable plate to move relative to the respective arm member about an axis transverse to the length of the respective arm member.

The hair styling apparatus may be a hair straightener or hair crimper for example. Such an apparatus provides a pivot about which the heatable plates can move in a "seesaw" type action (for example) between opposing sides of the plates (one end nearest the jaw, the other nearest the arm coupling).

The fact that one or both of the plates "seesaws" is beneficial over conventional forms of plate that may flex solely on a cushioning or suspension as it avoids any pressure differential across the plates. This means that ceramic heaters coupled to the underside of the plates are also not put under any undue stress and so reduces the risk of cracking and leads to an increase in lifetime.

This ensures good thermal contact with the hair as the appliance is moved. It will be appreciated that one or both of the arms may have a plate pivot, with the heatable plate on each arm moving about the pivot on the respective arm. In embodiments where both heatable plates are pivotable each heatable plate needs to move less, compared to a single pivoting plate, in order to achieve the same degree of relative rotation between each of the heatable plates.

Conventionally a user exerts a closing force on the arms which leads to the arms flexing and rotating the plates relative to one another. By providing a pivot about which the heatable plate(s) move/rotate (the plate pivot), the closing force needing to be applied by a user is reduced, making the apparatus easier to hold and use for styling.

Furthermore, this also increases the construction options available, allowing use of different materials that may not flex as well or as reliably.

In embodiments of the hair styling apparatus the plate pivot is configured to permit an end of the heatable plate of at least one arm furthest from the coupled ends of the arms to contact the heatable plate of the other arm first when moved from the open position to the closed position. Thus, in this arrangement, the plates may be biased such that when the plates move from an open to closed position, the heatable plates then first abut one another at the mouth end of the hair styler, i.e. at the end of at least one of the heatable plates furthest from the coupled end of the arms. In embodiments adopting such an arrangement, the heatable plates are then angled towards one another in the closed position as they first touch such that hair can be prevented from escaping, or falling off the end.

Further closing of the arms, for example by squeezing the arms together, may then rotate one or both of the heatable plates about its plate pivot such that the heatable plates are then able to abut flat against one another as the arms converge towards one another at their distal end. With such an additional squeezing force applied, hair to be styling is more forceably held within between the heater plates.

The plate pivot may be in a variety of positions along the heatable plate and in embodiments is may be spaced away from the end of the at least one heatable plate furthest from the coupled ends of the arms. In some embodiments the pivot may be positioned at an equal distance between ends of the heatable plate furthest from the coupled end of the arms and closest to the coupled end of the arms. In other variants the pivot may be at the end of the heatable plate closest to or furthest away from the coupled end of the arms. These variants allow may allow the degree of rotation to vary, depending on the particular construction and dimensions of the arm in which the heatable plate is mounted.

In some embodiments, this arm coupling may permit the arms to pivot relative to another other through the use of an arm pivot. In other embodiments, the arms may be formed from a continuous material or chassis, extending through a shoulder region that curves to allow the two arms to oppose one another. In such an embodiment, the arms are in effect coupled by a shoulder region that may be integrally formed with the arms. The shoulder/coupling may flex. Alternatively the shoulder may be rigid and coupled to the arms by a flexible/bendable/moveable regional allow relative movement of the arms.

In some embodiments the arms may be biased apart, enabling a user to clamp the heatable plates around a quantity of hair, straighten the hair, and then allow the arms to separate automatically as the hair clamping is relaxed.

The plate pivot may comprise a projection on one of the heatable plates or the respective arm member. This may then engage with a slot (or groove) on the other of the heatable plate/respective arm member, which receives the projection—it may snap fit into the slot for example to allow the plates to rotate about the plate pivot. In a variant, a ball and socket type joint may be used.

In one or both of the arms, the heatable plate coupled about the plate pivot may be biased parallel to the respective arm member of the heatable plate on the arm. This parallel biasing may preferably be when then arms are in the open position and thus when no pressure is applied to the heatable plate, thereby allowing a user to easily position/slide a quantity of hair between the plates.

The fact that at least one of the plates can rotate/move about a plate pivot means that the plates may be moveable to a generally parallel arrangement allowing a uniform clamping force to be applied. Therefore, in use, the at least one heatable plate may then move about the pivot responsive to clamping the arms about a quantity of hair. When the ends of the plates first abut one another, and as the clamping force is increased, the opportunity for hair to escape from the ends of the plates is reduced due to the increased pressure applied by a user. This means any opening formed at the ends of the plates does not lead to hair escaping.

In embodiments in which both arms comprise a plate pivot, both of the heatable plates may be moveable relative to their respective arm members about an axis transverse to the length of each of said respective arm members. In such variants any of the previously described features may be used. It is not necessary in such embodiments for both plate pivots to be positioned at the same point along each heater plate. The presence of two pivoting plates allows the plate pivot on the first arm and the plate pivot on the second arm to be positioned at different positions along the respective coupled heatable plate.

As it is important to ensure good thermal contact with the hair, at least one of the pivots may be supported on a resilient suspension to allow some sideways movement of each contacting surface relative to its arm. This further improves the contact between the hair and the heatable plates whilst still retaining the pivoting action. In some embodiments one or both pivots are supported on a resilient suspension.

Each arm may be generally elongate and with the heatable plates extending along at least part of the length of each of the respective arm members.

The heatable plates may be in thermal contact with a respective heater in the hair styling apparatus, such as an electric heating element.

The heatable plates may also be generally planar to provide a flat surface for straightening hair.

The heatable plates, in use, may heat a section of hair clamped between the heatable plates to at least 160° C.

The hair styling apparatus may further comprise a control system configured to control the operation of the heaters, which may interact with a temperature sensor for example, to control activation of the heaters or alert a user when the desired styling temperature (at least 160° C. for example) has been reached.

According to a second aspect of the invention there is provided a hair styling apparatus comprising a pair of arms, the arms having a first pivot at one end and being pivotable to close at an opposite end, at least one of the arms having a heatable plate at the opposite end, and wherein the heatable plate is mounted on a second pivot having an axis aligned with the first pivot, to enable the heatable plate to pivot as the arms are closed.

In the hair styling apparatus each arm may have a heatable plate with a respective second pivot. The plates may touch towards the opposite end as the arms close. In use, further closing of the arms rotates the heatable plates about their respective second pivots such that the heatable plates are able to abut flat against one another whilst the arms converge towards the opposite end.

One of more of the first aspects of the invention may also be applied to the second aspect of the invention.

Advantageously the heatable plates define a very flat, smooth surface. On the inner surface to which the heater is attached this helps to provide good thermal contact with the heater; on the outer surface it helps to provide a smooth surface, reducing friction with the hair to be styled.

Thus in a further aspect the invention provides a method of manufacturing a heater assembly for a hair styling appliance, the method comprising: providing a metal heat transfer element; shaping said metal heat transfer element by cold forging; milling flat at least one surface of said cold forged metal heat transfer element; and adding a heater to a surface of said metal heat transfer element.

In embodiments a first ("inner") surface of the metal heat transfer element (plate) is milled flat and the heater is provided on this surface. Additionally or alternatively just the "outer" surface, which interacts with the hair, is milled flat. In preferred embodiments, however, two opposite surfaces of the cold forged metal heat transfer element are milled flat. In embodiments the work hardening from the cold forging process can assist in achieving a smooth surface for improved heat transfer/reduced hair friction.

In embodiments the metal heat transfer element comprises an aluminium plate and the heater comprises a ceramic layer on the aluminium plate bearing an electrically conducting heating element. In preferred embodiments the heater is a single-sided ceramic heater, comprising a ceramic layer with an electrical conducting element on one face, a second opposite face of said ceramic layer being mounted on and in thermal contact with a face of a heating layer, and wherein said ceramic layer lacks a heating layer on said first face. In embodiments the cold forging comprises a stamp and bend process leaving said metal heat transfer element with curved edges.

BRIEF DESCRIPTION OF THE DRAWINGS

For a better understanding of the invention and to show how it may be carried into effect reference shall now be made, by way of example only, to the accompanying drawings in which.

DETAILED DESCRIPTION OF THE PREFFERED EMBODIMENTS

Figure 1:
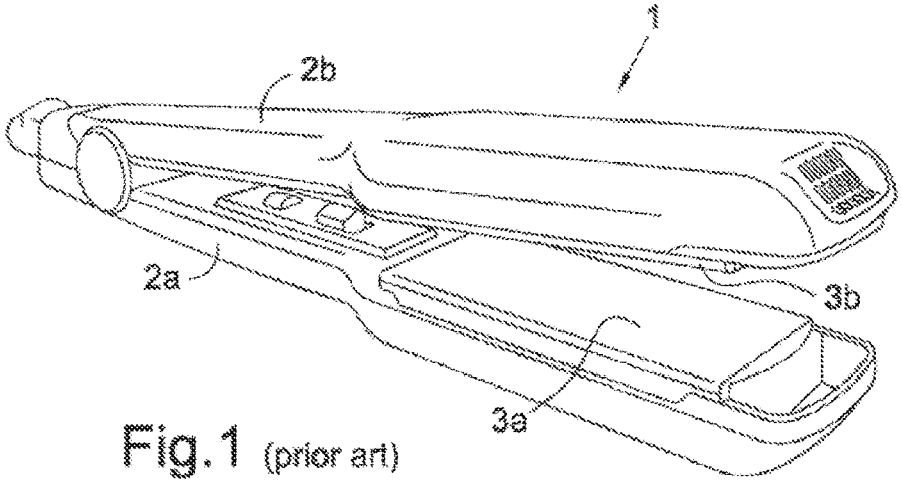
Fig.1 (prior art)
FIG. 1 shows an example of hair straighteners according to the prior art.
Figure 2:
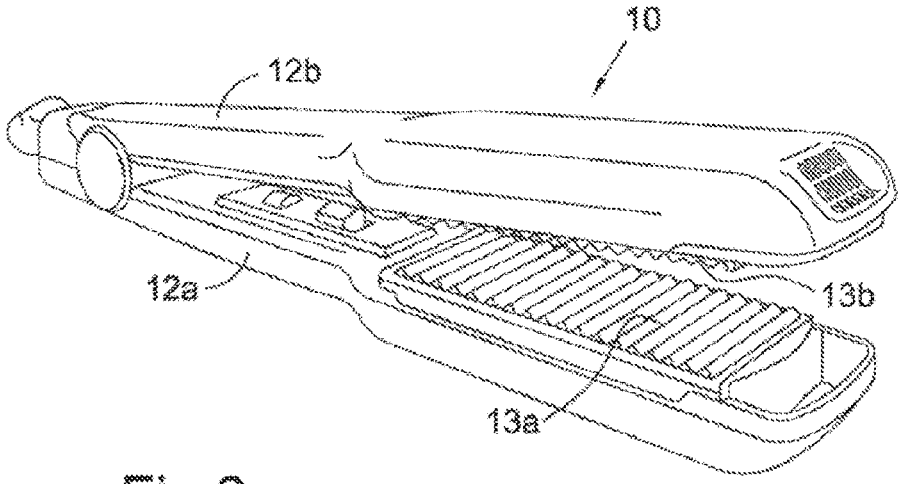
Fig 2 (prior art)
FIG. 2 shows an example of hair crimpers according to the prior art.
Figure 3A:
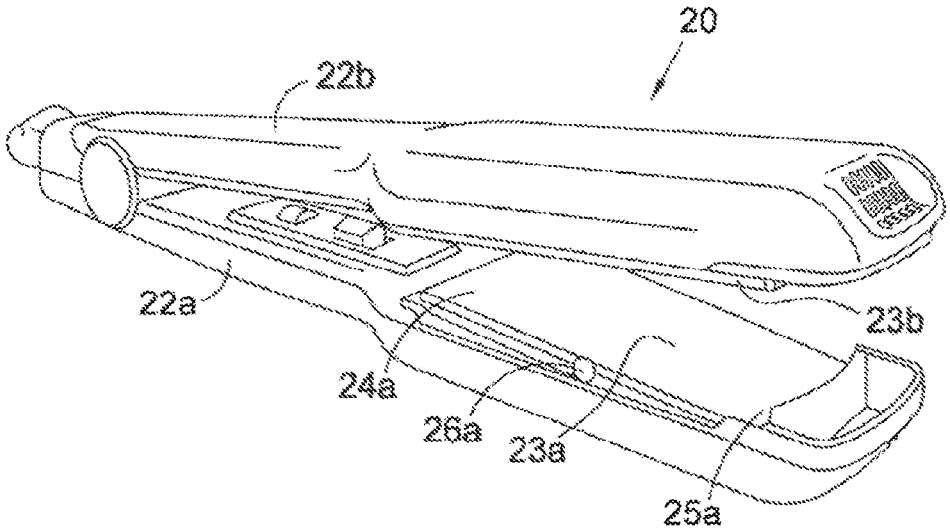
FIG. 3*a* shows an example of hair straighteners with pivotable plates.

Referring now to FIG. 3*a*, this shows an example embodiment of a hair styling apparatus 20 (in this example a hair straightener) with a pair of arms 22*a*, 22*b* and heatable plates 23*a* and 23*b*. FIG. 3*d* illustrates an example where the hair styling apparatus 20 is a hair crimper.

Heatable plate 23 is mounted to a pivot 26*a* (plate pivot) to allow the heatable plate to rotate about the pivot. In FIG. 3*a* plate 23*a* is shown angled downwards, with end 25*a* furthest away from the arm coupling below the pivot point and arm 24*a* above the pivot point. The heatable plate can rotate from this shown position to a second position in which end 25*a* is raised above the pivot point and end 24*a* falls below the pivot point. Plate 23*b* may similarly rotate about another pivot on arm 22*b* (not shown).

Figure 3B:
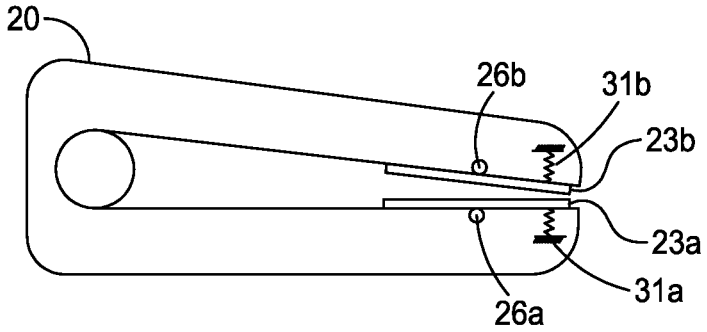
FIG. 3*b* shows the staighteners of FIG. 3*a* in a first closed position.

FIG. 3*b* shows the hair styler with both arms closed together. When closed, the arms are off-parallel, forming an acute angle between plates 23*a* and 23*b* meaning that the plates are also not parallel if they are biased by default parallel with their respective arm. Thus, in this arrangement, the plates may be biased (for example by biasing springs 31*a* and 31*b*) such that when the plates move from an open to closed position, the heatable plates then first abut one another at the mouth end of the hair styler, i.e. at the end of at least one of the heatable plates furthest from the arm coupling which connects the two arms of the hair styler together. This means that, in the closed position as the plates first touch, the ends of the heatable plates further from the arm coupling are closer to one another than the ends of the heatable plates closest to the arm coupling. Such an arrangement may be further used, for example, to enable the arms to first abut one other at the mouth end of the arm, i.e. the end furthest away from the arm coupling.

This arrangement is useful for ensuring that hair does not fall or get pushed off the end of the plates as pressure is applied to the hair.

Figure 3C:
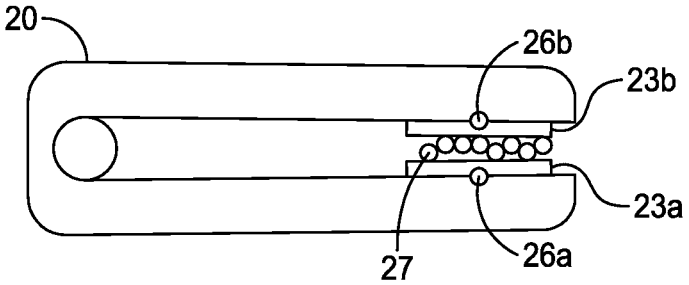
FIG. 3*c* shows the staighteners of FIG. 3*a* in a second position with hair clamped between the plates.
Figure 3D:
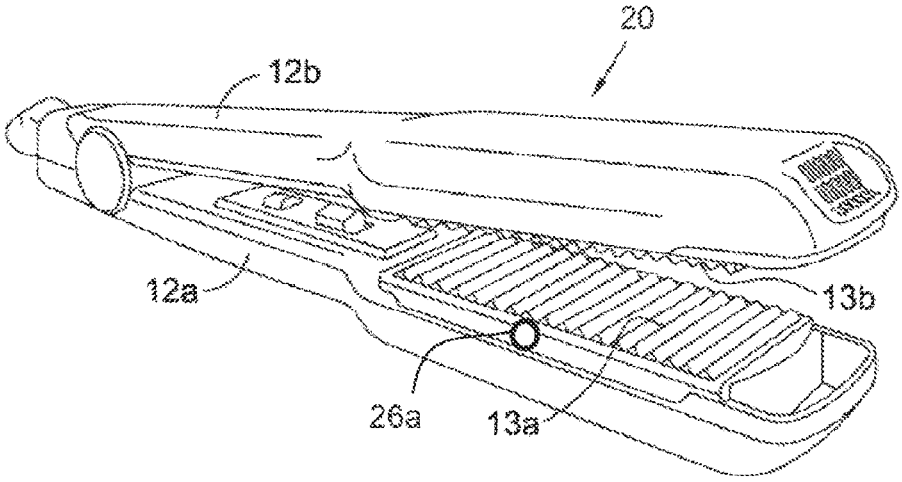
FIG. 3*d* shows an example of hair crimpers with pivotable plates.

With a further squeezing pressure applied to the arms of the hair styler after the plates first touch, the plates then pivot further, as depicted in FIG. 3*c*. FIG. 3*c* shows a quantity of hair 27 clamped between the plates by a user squeezing arms 23*a* and 23*b* together. In this example, the quantity of hair is slightly thicker at the end of the plates furthest away from the coupling end of the arms. Plates 23*a* and 23*b* can be seen to pivot about pivots 26*a* and 26*b* respectively to retain contact and a good grip on the hair along the length of the heatable plates.

In the embodiment in FIG. 3*a* the pivot is positioned at an equal distance between ends 24*a* and 25*a* of the plates. This arrangement allows the plates to first abut one another at the end of the plates furthest from the arm coupling when moved to the closed position, thereby preventing hair falling off the end of the plates. Further, in the example shown, the pivot 26*a* is provided by a projections extending sidewards from either side of plate 23*a* which engages with slots either side of plate 23*a* moulded into arm 22*a*. Such projections may be part of a heating plate assembly/housing to which the metal plate 23*a* is mounted. In variants it will be appreciated that slots may be provided on the plate/plate housing or assembly and the projections on the arm either side of the plates. Other examples of pivots are possible, for example, the pivot may be positioned below the plate, engaging with the plate/plate housing/assembly below the plate. A ball and socket type joint may then be used, which would provide a further option for sideways pivoting in addition to the action shown in FIG. 3.

One or both of heatable plates 23*a* and 23*b* are biased parallel to their respective arms 22*a* and 22*b* such that when in use and the styler is applied to hair or released, there is no risk of hair getting caught across any end of the plates.

Plate pivot 26*a* may be mounted on a resilient suspension to allow sideways movement of plate 23*a* relative to the arm which helps the plate retain contact with hair clamped as a user moves the styler during styling. The same applies to plate 23*b*. This may be use separately or in addition to a ball and socket type coupling below the plate within each arm.

Figure 4:
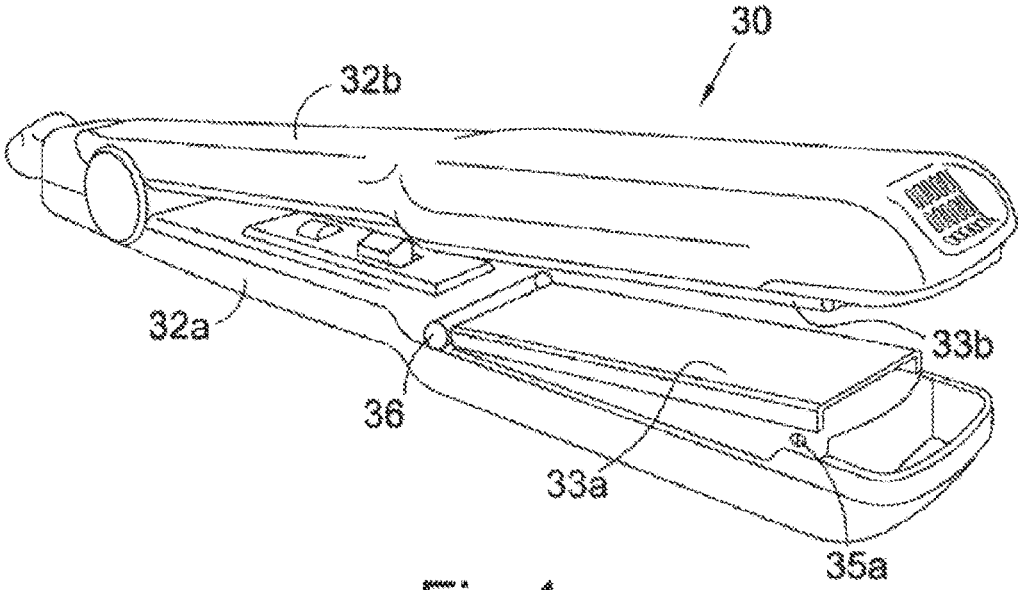
FIG. 4 shows a variant of the pivotable plates of FIG. 3*a;*

A variant of the FIG. 3*a* embodiment is shown in FIG. 4. In this variant, the hair straightener 30 comprises heatable plates 33*a* and 33*b*. Plate 33*a* is pivoted about plate pivot 36 positioned at the end of the plate closest to the arm coupling such that plate end 35*a* rotates. In this arrangement, the plates may be biased such that when the plates move from an open to closed position, the heatable plates again first abut one another at the mouth end of the hair styler, i.e. at the end of at the heatable plates furthest from the arm coupling which connects the two arms of the hair styler together. Thus, in the closed position, the ends of the heatable plates furthest from the arm coupling are closer to one another than the ends of the heatable plates closest to the arm coupling.

Figure 5:
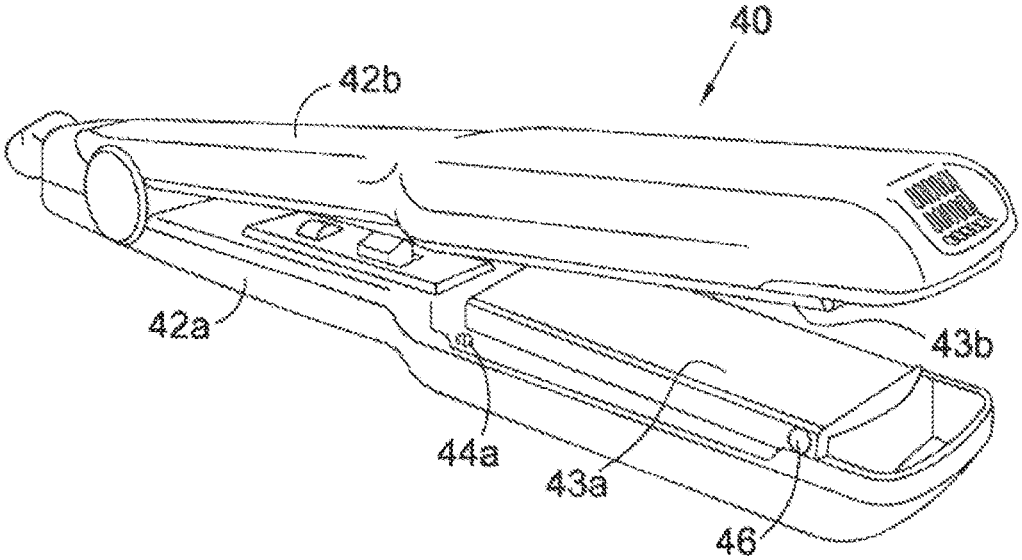
FIG. 5 shows a further variant of the pivotable plates of FIG. 3*a;*

In the variant shown in FIG. 5, hair straightener 40 comprises heatable plates 43*a* and 43*b*. Plate 43*a* is pivoted about pivot point 46 positioned at the end of the plate furthest away from the arm coupling such that end 44*a* rotates.

Figure 6:
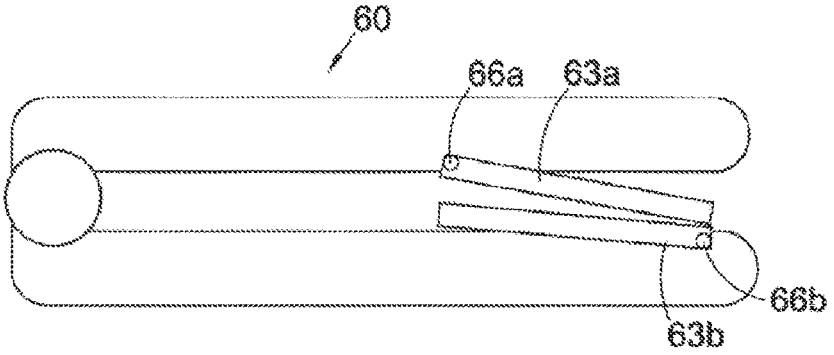
FIG. 6 shows a further variant of the pivotable plates combining the plate of FIGS. 4 and 5.

In the embodiments described in FIGS. 3*a-c*, 4 and 5, it is not necessary for the pivot to be in the same position on both heater plates. In variants, for example, a combination of the arrangements in FIGS. 4 and 5 may be used, as shown in FIG. 6. In this arrangement one heater plate 63*a* is pivoted at an end closest to the arm coupling, by pivot 66*a*, and the other heater plate 63*b* is pivoted at the end of the arm, by plate pivot 66*b*, furthest from the arm coupling. In this arrangement, the plates may again be biased such that when they move from the open to closed position, they first abut one another at the mouth end of the hair styler as shown in FIG. 6. In such an arrangement, when closed, the ends of the heatable plates furthest from the arm coupling are again closer to one another than the ends of the heatable plates closest to the arm coupling (as depicted in FIG. 6). The heater plates are then relatively biased such that they first abut at the end of the heater plate furthest from the arm coupling. To achieve this an end of the heater plate 63*a* biased according to FIG. 4 is arranged such that its other end (the mouth end) projects further towards the opposing arm than the arm coupling end of the other arm. The resulting effect is that when moving to the closed position, the arms then first abut one other at the mouth end of the arm, i.e. the end furthest away from the arm coupling.

Figure 7:
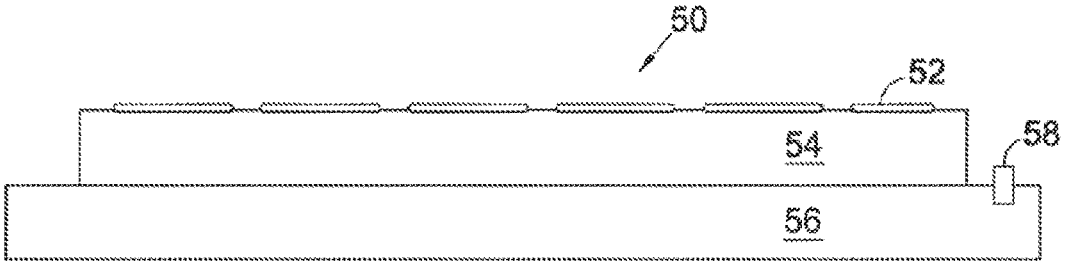
FIG. 7 schematically shows a vertical cross-section through a heater plate.
Figure 8:
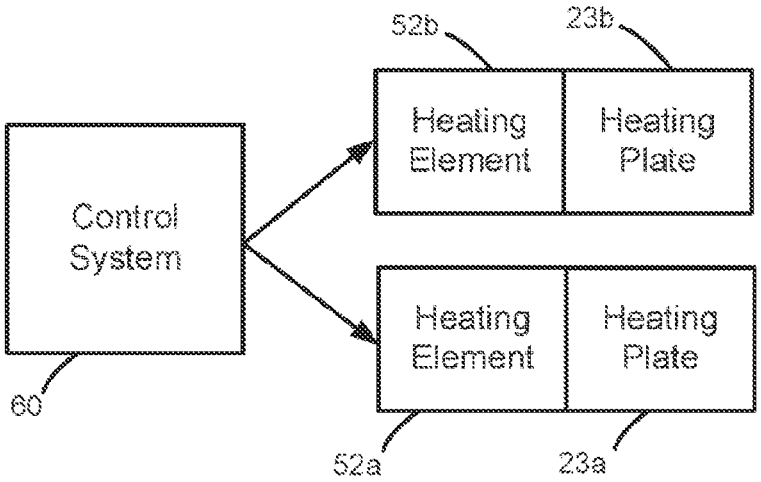
FIG. 8 is a block diagram of a control system forming part of the hair styler.

Referring now to FIG. 7, this shows a single-sided ceramic heater 50 comprising a metal, for example aluminium, heating plate 56 bearing a layer of ceramic 54, for example an oxide layer, on which is deposited an electrically conductive pattern 52 forming a heating element (or heater). The heating plate may incorporate a temperature sensor 58 such as a thermistor or thermocouple; alternatively the temperature sensor may be located elsewhere. FIG. 8 illustrates the control system 60 used to control the operation of the heaters 52*a* and 52*b* that are used to heat the heating plates 23*a* and 23*b* respectively.

To further improve contact with hair, the heatable plate 56 may be cold forged then milled, to provide a very flat surface. The plate may be formed by shaping the metal plate, (for example by stamping then bending), followed by milling to provide the flat surface. Milling may also be used to flatten a screw boss, or any other securing feature used to hold the plate to the heater and any form of substrate/enclosure.

Such a process may be applied to one or both sides of the heatable plate 56 to improve thermal contact with one or both of the ceramic heater 54 used to heat the plate and hair in contact with the heatable plate 56 during styling.

It will be understood that one or both of the heatable plates may pivot, and the examples shown in attached figures shown only one heatable plate being able to rotate for simplicity.

No doubt many other effective alternatives will occur to the skilled person. It will be understood that the invention is not limited to the described embodiments and encompasses modifications apparent to those skilled in the art lying within the spirit and scope of the claims appended hereto.

Through out the description and claims of this specification, the words "comprise" and "contain" and variations of the words, for example "comprising" and "comprise", means "including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

What is claimed:

1. A hair styling apparatus comprising a first arm and a second arm coupled at one end, and each of said first and second arms having a first end and second end and comprising a heatable plate, a heater for heating the heatable plate, and a plate pivot connecting the heatable plate to the respective first or second arm, the first ends forming the coupled end;

wherein the first and second arms are moveable between a closed position in which said heatable plate of said first arm is adjacent said heatable plate of said second arm and an open position in which said heatable plates of the first and second arms are spaced apart, wherein each heatable plate has an inner surface that faces the respective arm and an outer surface that faces the outer surface of the other heatable plate when the first and second arms are in the closed position, wherein each plate pivot is arranged to allow its respective heatable plate to move relative to its respective arm about an axis transverse to a length of its respective arm, the plate pivot comprising a projection extending from said heatable plate or the first or second arm of said heatable plate that engages a slot on said respective arm or said heatable plate, wherein said heatable plate of said first arm is biased so that an end of said heatable plate furthest from said coupled ends of said first and second arms contacts said heatable plate of said second arm first and then applies pressure to hair when said first and second arms are moved from said open position to said closed position, wherein the first arm further comprises a first biasing spring configured to bias the heatable plate of said first arm, the first biasing spring near the end of said heatable plate furthest from said coupled ends of said first and second arms; wherein the second arm further comprises a second biasing spring configured to bias the heatable plate of said second arm, the second biasing spring near the end of said heatable plate furthest from said coupled ends of said first and second arms; and wherein the heater of each of the first and second arms is positioned adjacent to and in thermal contact with the inner surface of the respective heatable plate.

2. A hair styling apparatus as claimed in claim 1, wherein said plate pivot is positioned at an end of said at least one heatable plate closest to said coupled end of said arms.

3. A hair styling apparatus as claimed in claim 1, wherein at least one of the plate pivots is positioned at an end of its respective heatable plate that is furthest from said coupled end of said arms.

4. A hair styling apparatus as claimed in claim 1, wherein, in use, closing of said first and second arms rotates said at least one heatable plate about its plate pivot such that said heatable plates are able to abut flat against one another whilst said first and second arms converge towards said closed position.

5. A hair styling apparatus as claimed in claim 1, wherein at least one of said heatable plates is biased parallel to its respective arm is biased parallel to said at least one arm when in said open position.

6. A hair styling apparatus as claimed in claim 1, wherein, in use, at least one of said heatable plates is arranged to move about its respective plate pivot responsive to clamping said first and second arms about a quantity of hair.

7. A hair styling apparatus as claimed in claim 1, wherein each of said first and second arms is generally elongate and said heatable plates extend along at least part of a longitudinal length of the respective arm.

8. A hair styling apparatus as claimed in claim 1, wherein, in use, the heaters are configured to heat the heatable plates to a temperature so that a section of hair that is clamped between the heatable plates is heated to at least 160° C.

9. A hair styling apparatus as claimed in claim 1, further comprising a control system configured to control operation of said heaters.

10. A hair styling apparatus as claimed in claim 1, wherein said heatable plates are generally planar.

11. A hair styling apparatus as claimed in claim 1, wherein said hair styling appliance is a hair straightener.

12. A hair styling apparatus as claimed in claim 1, wherein said hair styling appliance is a hair crimper.

* * * * *